US011293669B2

(12) United States Patent
Anderson et al.

(10) Patent No.: US 11,293,669 B2
(45) Date of Patent: Apr. 5, 2022

(54) HEAT BALANCING SYSTEM

(71) Applicant: Ademco Inc., Golden Valley, MN (US)

(72) Inventors: Peter Anderson, St. Paul, MN (US); Shanna Lorraine Leeland, St. Paul, MN (US)

(73) Assignee: Ademco Inc., Golden Valley, MN (US)

( * ) Notice: Subject to any disclaimer, the term of this patent is extended or adjusted under 35 U.S.C. 154(b) by 192 days.

(21) Appl. No.: 16/834,841

(22) Filed: Mar. 30, 2020

(65) Prior Publication Data

US 2020/0232679 A1 Jul. 23, 2020

Related U.S. Application Data

(63) Continuation of application No. 12/769,081, filed on Apr. 28, 2010, now Pat. No. 10,634,385, which is a continuation-in-part of application No. 12/553,795, filed on Sep. 3, 2009, now Pat. No. 8,297,524.

(51) Int. Cl.
*F24H 9/20* (2006.01)
*F24H 1/20* (2022.01)

(52) U.S. Cl.
CPC ..... *F24H 9/2035* (2013.01); *F24H 1/205* (2013.01)

(58) Field of Classification Search
CPC ..... F24H 9/2035
See application file for complete search history.

(56) References Cited

U.S. PATENT DOCUMENTS 2,254,960 A 9/1941 Harris
2,278,927 A 4/1942 Hemry
3,708,737 A 1/1973 Johnson
3,818,297 A 6/1974 Ha et al.
3,847,350 A 11/1974 Thompson
3,849,350 A 11/1974 Matsko
(Continued)

FOREIGN PATENT DOCUMENTS

EP 0356609 3/1990
GB 2211331 6/1989

OTHER PUBLICATIONS

Honeywell D896 Automatic Vent Damper, Product Data, 12 pages, 1997. (Applicant points out, in accordance with MPEP 609.04(a), that the year of publication, 1997, is sufficiently earlier than the effective U.S. filing date, so that the particular month of publication is not in issue.).

(Continued)

*Primary Examiner* — Nathaniel Herzfeld
(74) *Attorney, Agent, or Firm* — Shumaker & Sieffert, P.A.

(57) ABSTRACT

A heat balancing system for a natural draft gas burning appliance having a flue. When the appliance is in a standby mode, a main burner is shut off and the pilot light remains on. Temperature in the heat exchanger (e.g., temperature of water in a heater tank) may be decreased or increased, respectively, by opening or closing a damper in a flue as needed. If opening the damper does not sufficiently reduce the temperature of the heat exchanger, then the pilot light may be shut off to further reduce the temperature. The pilot light may be turned on again to bring up the temperature. There may be a control or controller to operate the damper to maintain the temperature of the exchanger within a certain range. Electrical power may be provided for the system from a power line, a storage device, or other source.

20 Claims, 6 Drawing Sheets

(56) References Cited

U.S. PATENT DOCUMENTS 4,204,833 A 5/1980 Kmetz et al.
4,256,257 A 3/1981 Pinkerton
4,267,965 A 5/1981 Everett
4,299,554 A 11/1981 Williams
4,324,944 A 4/1982 Weihrich et al.
RE30,936 E 5/1982 Kmetz et al.
4,333,002 A 6/1982 Kozak
4,390,123 A 6/1983 McCabe
4,460,329 A 7/1984 Trent
4,508,261 A 4/1985 Blank
4,511,790 A 4/1985 Kozak
4,538,980 A 9/1985 Hoyme
4,564,003 A * 1/1986 Iwanicki ..... F24D 17/0068 122/14.21
4,588,875 A 5/1986 Kozak et al.
4,692,598 A 9/1987 Yoshida et al.
4,696,639 A 9/1987 Bohan, Jr.
4,734,658 A 3/1988 Bohan, Jr.
4,742,210 A 5/1988 Tsuchiyama et al.
4,752,210 A 6/1988 Trent
4,770,629 A 9/1988 Bohan, Jr.
4,778,378 A 10/1988 Dolnick et al.
4,834,284 A 5/1989 Vandermeyden
4,835,670 A 5/1989 Adams et al.
4,880,376 A 11/1989 Bartels et al.
4,984,981 A 1/1991 Pottebaum
4,986,468 A 1/1991 Deisinger
5,007,156 A 4/1991 Hurtgen
5,039,006 A 8/1991 Habegger
5,276,630 A 1/1994 Baldwin et al.
5,312,629 A 5/1994 Beres et al.
5,442,157 A 8/1995 Jackson
5,447,125 A 9/1995 McNally et al.
5,612,629 A 3/1997 Mullin et al.
5,622,200 A 4/1997 Schulze
5,652,525 A 7/1997 Mullin et al.
5,660,328 A 8/1997 Momber
5,720,608 A * 2/1998 Aoki ..... F23N 5/102 431/80
5,797,358 A 8/1998 Brandt et al.
5,896,089 A 4/1999 Bowles
5,968,393 A 10/1999 Demaline
5,975,884 A 11/1999 Dugger
6,048,193 A 4/2000 Juntunen et al.
6,053,130 A 4/2000 Shellenberger
6,059,195 A 5/2000 Adams et al.
6,208,806 B1 3/2001 Langford
6,257,871 B1 7/2001 Weiss et al.
6,261,087 B1 7/2001 Bird et al.
6,271,505 B1 8/2001 Henderson
6,293,471 B1 9/2001 Stettin et al.
6,350,967 B1 2/2002 Scott
RE37,745 E 6/2002 Brandt et al.
6,560,409 B2 5/2003 Troost, IV
6,584,197 B1 6/2003 Boudreaux et al.
6,644,957 B2 11/2003 Weiss
6,684,821 B2 2/2004 Lannes et al.
6,701,874 B1 3/2004 Schultz et al.
6,838,847 B2 1/2005 Dragoni et al.
6,880,493 B2 4/2005 Clifford
6,934,862 B2 8/2005 Sharood et al.
6,955,301 B2 10/2005 Munsterhuis et al.
6,959,876 B2 11/2005 Chian et al.
7,205,737 B1 4/2007 Bilodeau
7,205,892 B2 4/2007 Luebke et al.
7,221,862 B1 5/2007 Miller et al.
7,252,502 B2 8/2007 Munsterhuis
7,275,533 B2 10/2007 Soeholm et al.
7,317,265 B2 1/2008 Chian et al.
7,712,677 B1 5/2010 Munsterhuis et al.
7,721,972 B2 5/2010 Bracken et al.
7,747,358 B2 6/2010 Troost et al.
7,804,047 B2 9/2010 Zak et al.
8,082,888 B2 12/2011 Lannes et al.
8,113,823 B2 2/2012 Guzorek
8,297,524 B2 10/2012 Kucera et al.
8,473,229 B2 6/2013 Kucera et al.
8,632,017 B2 1/2014 Kucera et al.
2003/0075118 A1 4/2003 Lannes et al.
2003/0170578 A1 9/2003 Weiss
2005/0066958 A1 3/2005 Guzorek
2005/0087221 A1 * 4/2005 Shah ..... F24F 5/0042 136/205
2005/0161518 A1 7/2005 Munsterhuis
2005/0247304 A1 11/2005 Weiss
2006/0150925 A1 7/2006 Akkala et al.
2006/0214015 A1 9/2006 Furakawa et al.
2007/0023333 A1 2/2007 Mouhebaty et al.
2007/0187519 A1 8/2007 Bracken et al.
2007/0281257 A1 12/2007 Hughes et al.
2010/0173252 A1 7/2010 Bracken et al.
2011/0048340 A1 3/2011 Anderson et al.
2011/0270544 A1 11/2011 Kucera et al.

OTHER PUBLICATIONS

Honeywell S8610U Universal Intermittent Pilot Module, Installation Instructions, 20 pages, Aug. 1996.
Johnson Controls Q135 Automatic Flue Damper System, 8 pages, 1998. (Applicant points out, in accordance with MPEP 609.04(a), that the year of publication, 1998, is sufficiently earlier than the effective U.S. filing date, so that the particular month of publication is not in issue.).
Lennox, "Network Control Panel (NCP), User's Manual," 18 pages, Nov. 1999.
Weil-McLain, Technical Services Bulletin No. SB201, 2 pages, Nov. 20, 2002.
Wohlfarth, "The misunderstood barometric damper," PME, accessed from https://www.pmengineer.com/articles/90570-the-misunderstood-barometric-damper, Feb. 13, 2013, 4 pp.
Notice of Allowance from U.S. Appl. No. 12/553,795, dated Jun. 29, 2012, 8 pp.
Prosecution History from U.S. Appl. No. 12/769,081, dated Mar. 20, 2013 through Dec. 19, 2019, 322 pp.
Prosecution History from U.S. Appl. No. 13/662,089, dated Apr. 12, 2013 through Sep. 13, 2013, 26 pp.

* cited by examiner

HEAT BALANCING SYSTEM

This application is a continuation of U.S. patent application Ser. No. 12/769,081, filed Apr. 28, 2010 which is a continuation-in-part of U.S. patent application Ser. No. 12/553,795, filed Sep. 3, 2009, the entire content of each of which is hereby incorporated by reference.

U.S. patent application Ser. No. 11/276,121, filed Feb. 15, 2006, and entitled "Appliance Control with Automatic Damper Detection", is a related application. U.S. patent application Ser. No. 11/276,121, filed Feb. 15, 2006, is hereby incorporated by reference.

BACKGROUND

The present invention pertains to devices for building control systems and particularly damper control devices. More particularly, the invention pertains to damper control devices for fuel fired appliances.

SUMMARY

The invention is a heat balancing system for a natural draft gas burning appliance having a flue. When the appliance is in a standby mode, a main burner is shut off and the pilot light remains on. Blocking the flue may cause significant heat rise in a water tank (e.g., water heater) due to heat from the pilot light. Temperature in the heat exchanger (e.g., temperature of water in a heater tank) may be maintained by opening and closing a damper in a flue as needed. If opening the damper does not sufficiently reduce the temperature of the heat exchanger, then the pilot light may be shut off to further reduce the temperature. The temperature of the exchanger may fall further than desired due to a lack of heat in the stand-by mode. Thus, the pilot light may be turned on again to bring up the temperature. There may be a control or controller to operate the damper to maintain the temperature of the exchanger within a certain range. The damper may be operated as completely open and closed, or partially open and closed.

Electrical power may be provided from line power, a storage device or other source for the control or controller, an electrical drive for the damper, pilot light shut-off valve, and other like items as needed for the heat exchanger. In the case of the storage device, it may be recharged with a light- or heat-to-electric converter. The light or heat may be provided by the pilot light.

DESCRIPTION

Flue dampers may greatly improve the efficiency of natural draft gas burning appliances. However, when used with a standing pilot system, blocking the flue may cause excessive heat rise in the heat exchanger due to heat from the pilot. This phenomenon appears especially true in water heaters. Blocking the flue on a standing pilot water heater may result in excessive water temperature eventually causing a relief valve or a high limit switch to open.

Figure 1:
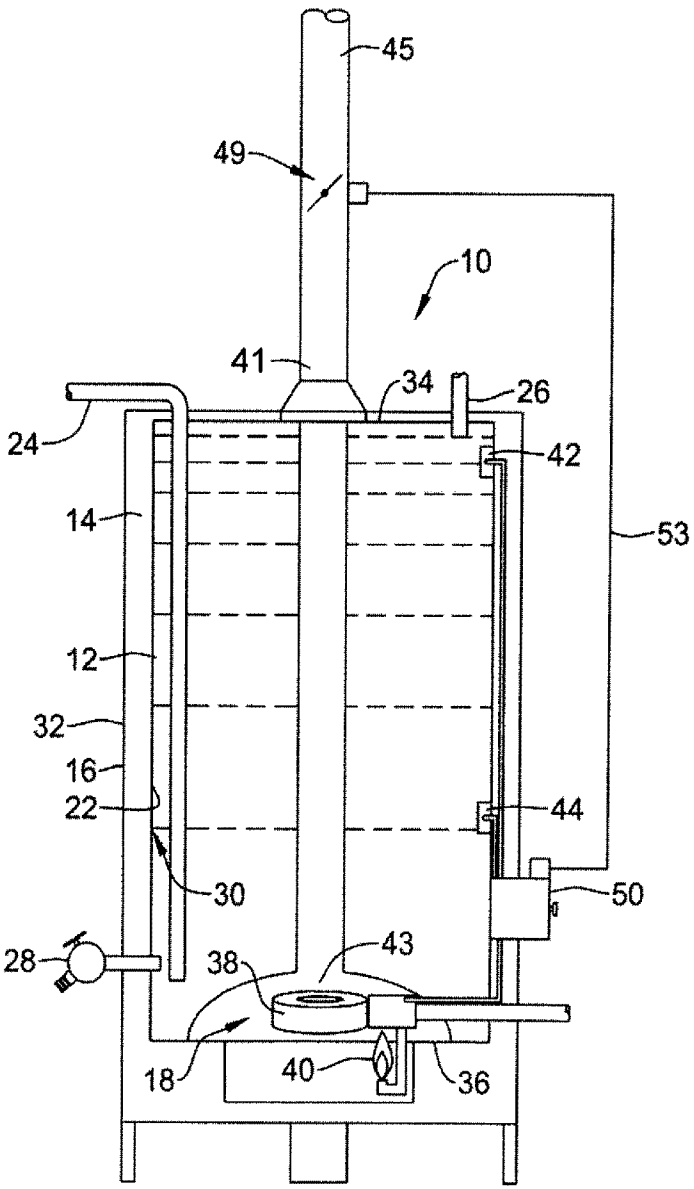
FIG. 1 is a diagram of cutaway side view of an illustrative fuel fired appliance.

FIG. 1 is cutaway view of an illustrative example of a natural gas burning appliance such as a water heater 10. The illustrative water heater 10 may incorporate a tank 12, an insulating layer 14, an external shell 16, a heater 18, and a controller 50. Tank 12 may hold water that is to be heated and be constructed of steel or other heat conducting material. Tank 12 may have an inner surface 22, an input supply tube or dip tube 24, an output conduit or pipe 26, a drainage valve 28, a rust inhibiting liner 30, and an cuter surface 32.

Insulating layer 14 may be located between outer surface 32 of tank 12 and external shell 16. Insulating layer 14 may limit or otherwise minimize the heat loss of the heated water from passing from tank 12 to the outside world. Bonded to the inside of inner surface 22 may be a rust inhibiting liner 30. In addition, tank 12 may have a sacrificial anode rod (not illustrated) to keep tank 12 from corroding, and have flue baffling which is designed to optimize heat exchange between combustion by-products and water. It may be like a secondary heat exchanger.

Tank 12 may also have a top surface 34 and a bottom surface 36. Dip tube 24 and output pipe 26 may pass through top surface 34. Output pipe 26 may extend through top surface 34 to a second predetermined distance from bottom surface 36. This second predetermined distance may be fairly close to top surface 34.

Heater 18 may heat tank 12 and tank 12 may heat water inside it. Temperature of the water in tank 12 may be detected by one or more temperature sensors 42 and 44, which are connected to controller 50. Heater 18 may have one or more gas-fired burners 38 and a pilot 40 located in a combustion chamber 43.

The heat output of heater 18 may be controlled by burner orifice size, gas pressure, and/or time. To produce heat in the gas-fired water heater, gas may flow into burner 38 in the combustion chamber 43 through the gas-flow valve, where pilot source 40 ignites the gas. Pilot 40 may also produce heat resulting in heating the water or keeping it hot. The gas may continue to burn until the supply of gas is terminated. The burner 38 and pilot 40, which are situated in combustion chamber 43, may be in fluid communication with an exhaust outlet, such as a flue 41. The flue 41 may be coupled to a vent pipe 45 that vents combustion gases exiting from the combustion chamber 43 to the atmosphere (e.g., outside of the building).

In some cases, the combustion gases may be vented via flue 41 and vent pipe 45 through natural convection. Alternatively, a fan or like (not shown) may be provided to help force the combustion gases through the flue 41 and vent pipe 45 to the atmosphere. In either case, during off-cycle periods, the water heater 10 may lose heat through the flue 41 and vent pipe 45 to the atmosphere by natural convection and conduction. To help reduce these losses, a damper 49 may be installed either at the flue 41 exit or in the vent pipe 45.

In some cases, one or more electric motor controlled dampers may be used. The damper 49 shown in FIG. 1 may be one such electric motor controlled damper. The damper 49 may be controlled by a controller 50 or the like via wiring 53. In some cases, the damper 49 may be controlled to open when combustion of either burner 38 and/or pilot 40 in the combustion chamber 43 starts, and close immediately or sometime after combustion stops. This may help minimize the off-cycle heat losses that may occur through natural convection through the vent pipe 45 to the atmosphere.

Figure 2:
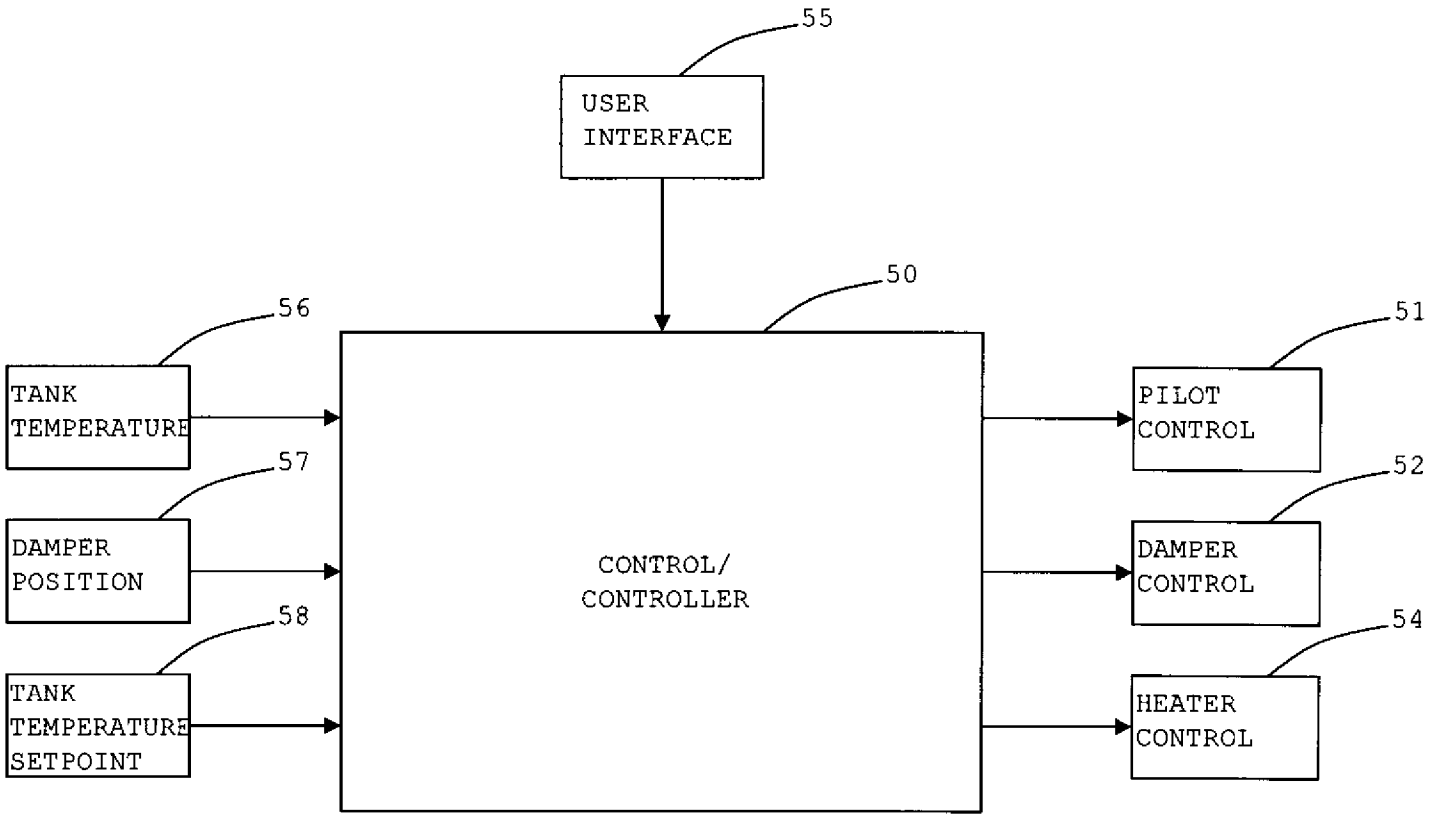
FIG. 2 is a diagram of an illustrative controller for operating and/or controlling the appliance of FIG. 1.

FIG. 2 is a block diagram of a control or controller 50. A user interface 55 of controller 50 may be for control, entry, observing a display, and so forth. User interface 55 may be utilized for installing a program or function in controller 50 to control burner 38, pilot 40 and damper 49 control in appliance 10. An input 56 to controller 50 may be for receiving tank 12 water temperature indications from sensors 42 and 44. An input 57 to controller 50 may be for receiving a damper 49 position in flue 41 or vent pipe 45. An input 58 to controller 50 may be for receiving a tank temperature setpoint. An output 51 from controller 50 may be for controlling pilot 40. An output 52 from controller may be for controlling damper 19. An output 54 may be for controlling burner 38.

The present approach may solve the problem of excessive heat rise in an appliance, for example, a water heater, by controlling the damper based on the temperature of a medium. In the case of a water heater, water temperature may be monitored. When the appliance off-state or off-cycle (i.e., the burner is not running or the main fuel valve is closed) temperature is seen to be rising, or when it exceeds a threshold, the damper may be opened by some amount to allow heat loss up the flue. Instead of water temperature; air temperature, a temperature of the heat exchanger itself, or some other temperature indication may be used.

One way to control heat rise is to cut a relief area in the damper plate to allow heat to escape. While effective, the relief area should be fine-tuned to each appliance and even to different installations. In addition, a relief area may directly reduce the effectiveness of the damper's impact on efficiency. It is likely that many installations will have more relief area than required to maintain a constant temperature or keep from resulting in a dropping temperature. Heat rise may be controlled also by making the damper smaller than necessary so that the relief area is the distance between the damper and the flue (circular dimension) and not a notch in the center of the damper.

A water heater control may be capable of measuring water temperature in the tank and be in control of the flue damper. It may be in direct control of the damper or it may provide signals to a separate damper controller. During the off-cycle, a situation may be that the pilot is burning, the main fuel (e.g., gas) valve is off, and the damper is closed. In some cases, this situation may lead to heating of the water due to the pilot flame, particularly in significantly energy efficient or small water heaters. The control or controller may continue to monitor water temperature. If the water temperature is approaching some first threshold value, then the damper may be opened to allow heat to escape up the flue. Once the temperature comes down below a second threshold value, the damper may be closed again. The first threshold value is greater than the second threshold value.

Alternatively, the control may partially open the damper in an attempt to balance heat loss and maintain a somewhat constant water temperature. In this case, the damper may be continually adjusted to basically maintain a setpoint temperature in the off-cycle.

The present approach may be extended further to encompass intermittent pilot systems as well. Using the fact that the pilot may be capable of adequately warming the heat exchanger (e.g., the tank of a water heater) with the damper closed, a control may light the pilot to satisfy light heating demands and leave the main fuel valve closed. More than needed heat may be balanced by using the damper or cycling the pilot. In flame-powered systems, the control may be required to periodically light the pilot to recharge batteries or capacitors via thermocouples, solar cells, or other heat or light to electric energy converters. In this case, the damper may be used to guard against overheating the appliance during the battery or capacitor recharge phase.

One may have a standing pilot and millivolt (mV) damper control strategy for prevention of tank failure due to overheating. Flue dampers have not been successfully applied to smaller fossil fuel water heaters due to hazards of overheating. Sizing a pilot may require a minimum orifice opening to pass agency testing when running at reduced rates to ensure that the main burner light is off. If one wishes to apply a damper to the fossil fuel appliance, one will likely compromise appliance optimization in order to prevent heat build up in the flue chamber during a standby mode with the pilot operating. This heat build-up may eventually blow the temperature and pressure relief (T&P) valve or a high temperature limit.

Because many manufacturers may prefer a standing pilot approach that does not require additional outside electricity to be introduced, and can be used in existing systems which utilize metal flue piping (i.e., no need to convert to PVC as it may be very expensive). The algorithm herein may allow manufacturers to maximize insulation on a tank to reduce standby losses, and yet prevent a water vessel from becoming overheated due to the minimum orifice size needed for the standing pilot application. The secondary effect of this system may be an increase in efficiency by ensuring that heat from the standing pilot has an opportunity to be transferred into the tank without overheating it.

One may have an intermittent pilot and millivolt damper control strategy for optimization of heat transfer of the pilot during long standby periods without over-temping the tank. Again, many manufacturers may prefer a standing pilot system that does not require additional outside electricity to be introduced or new flue piping added. The algorithm herein may allow manufacturers to maximize insulation on a tank to reduce standby losses, prevent a water vessel from becoming overheated due to the minimum size orifice needed for the standing pilot application, introduce intermittent spark as an approach to relight the pilot when tank is at setpoint during standby, and also use short pulse burns with the pilot to keep the tank at setpoint for long periods of time without the need to fire the main burner.

Figure 3:
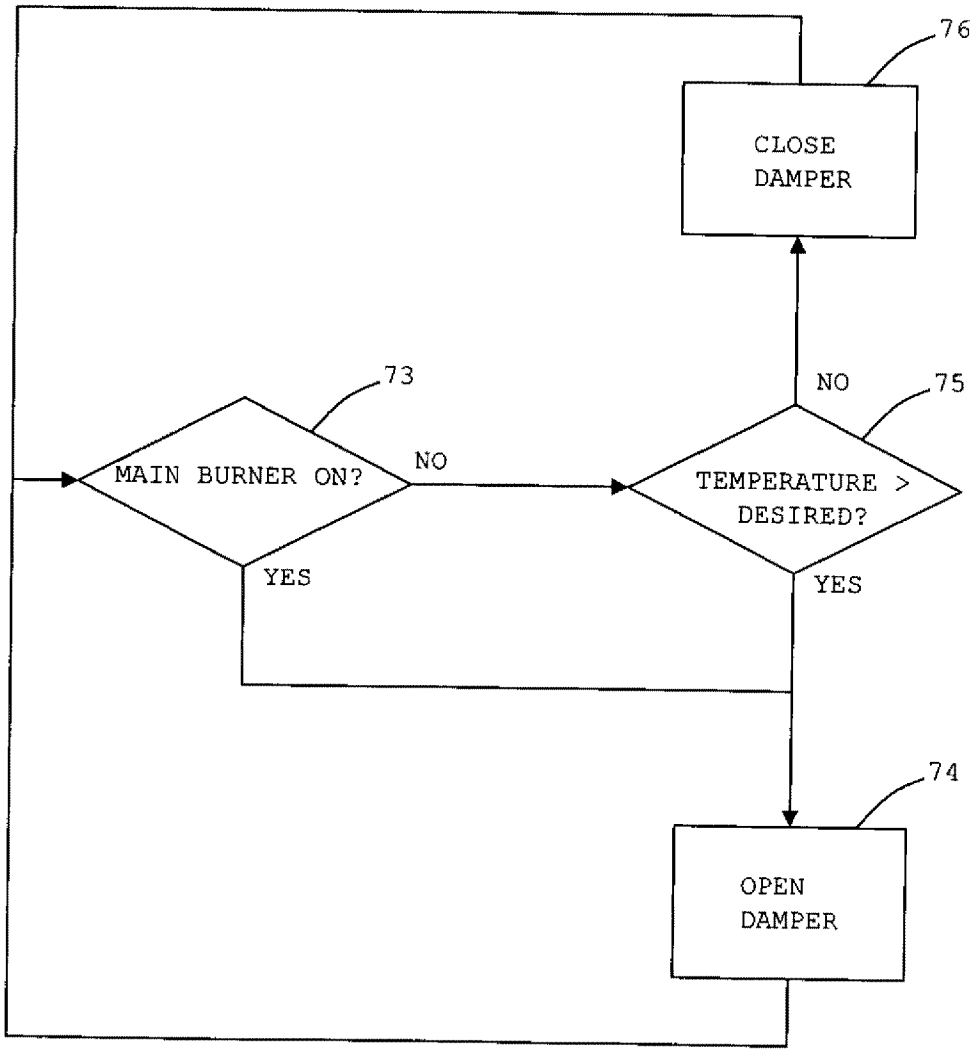
FIG. 3 is a flow diagram showing temperature control using basic open and closed positions of a damper.

FIG. 3 is a flow diagram showing temperature control using basic discrete open and closed positions of a damper. At symbol 73 may be a question of whether the main burner is on (or there is a request to turn the main burner on). If the answer is yes, the damper is opened at symbol 74. If the answer is no, then a question of whether the temperature is greater than a desired temperature may be asked at symbol 75. If the answer is yes, then the damper is opened at symbol 74. If the answer is no, then the damper is closed at symbol 76. The positions of the damper may be fed from symbols 74 and 76 to symbol 73.

Figure 4:
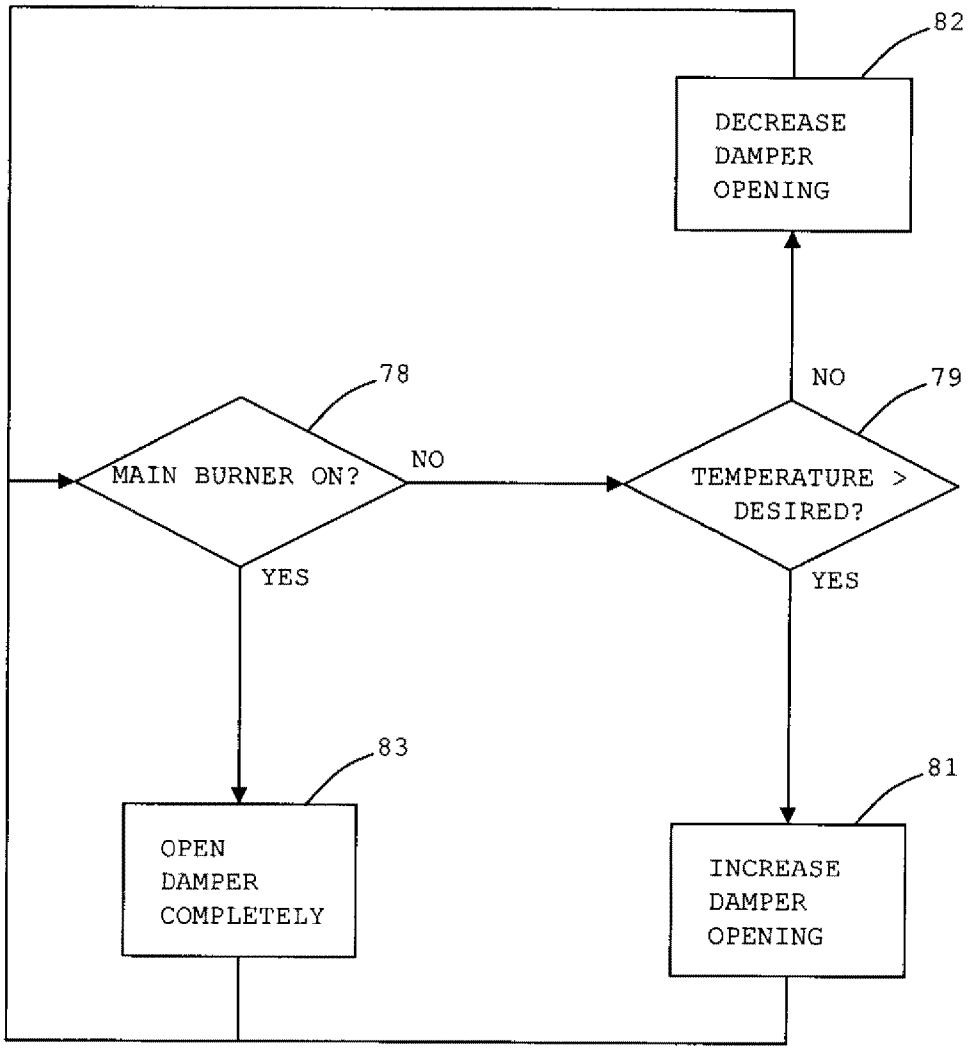
FIG. 4 is a flow diagram showing temperature control using variable positions of the damper.

FIG. 4 is a flow diagram showing temperature control using variable or partially open and partially closed positions of the damper. At symbol 78 may be a question of whether the main burner is on (or there is a request to turn the main burner on). If the answer is yes, then the damper may be opened completely at symbol 83. If the answer is no, then a question of whether the temperature is greater than a desired may be asked at symbol 79. If the answer is yes, then the opening of the damper may be increased at symbol 81. If the answer is no, then the opening of the damper may be decreased at symbol 82.

Figure 5:
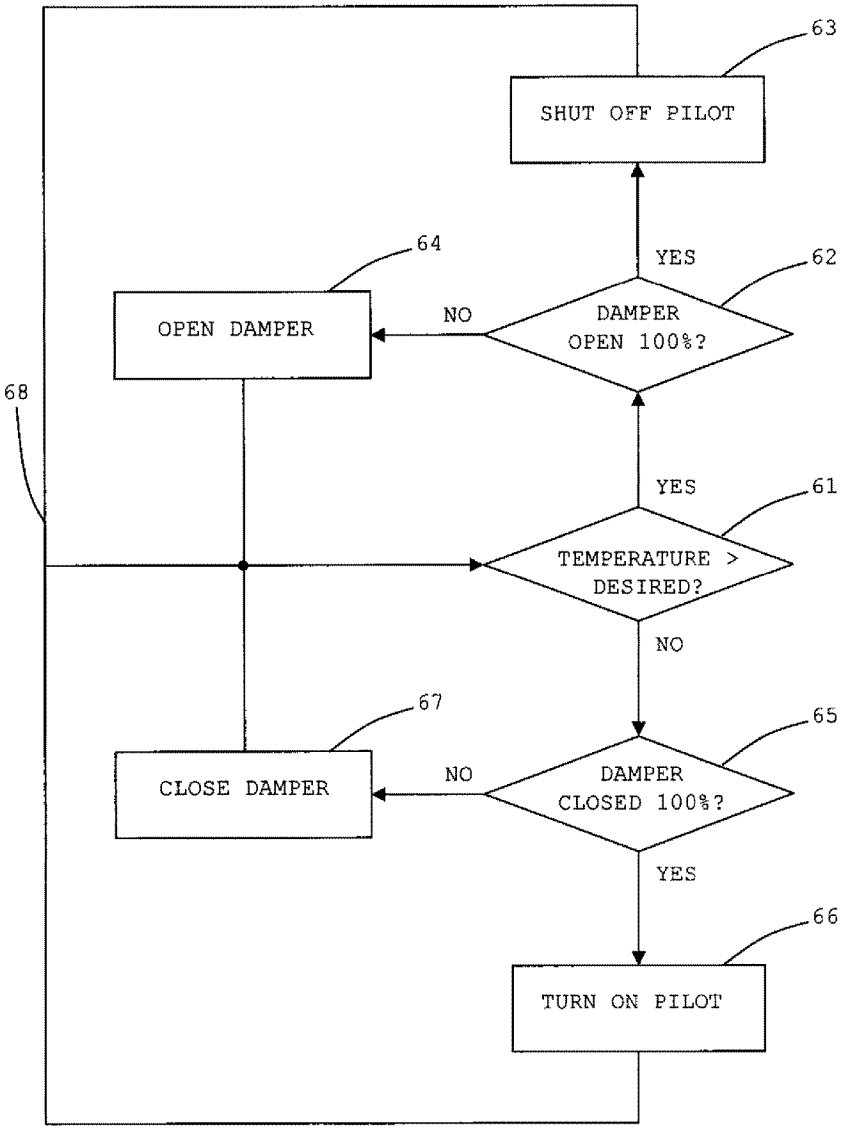
FIG. 5 is a flow diagram showing heating water in a heater tank with just a pilot light.

FIG. 5 is a flow diagram showing controlling heating water in the heater tank with just a pilot light. A question of whether the temperature of the water in a heater tank is greater than desired is asked at symbol 61. If the answer is yes, then a question of whether the damper is open 100 percent may be asked at symbol 62. If the answer is yes, then the pilot may be shut off at symbol 63. If the answer is no, then the damper may be opened at symbol 64. If the answer to the question at symbol 61 is no, then a question of whether the damper is closed 100 percent may be asked at symbol 65. If the answer is yes, then the pilot may be turned on at symbol 66. If the answer is no, then the damper may be closed at symbol 67. Indications of the status of the pilot light and the damper may be fed to symbol 61 via lines 68.

Figure 6:
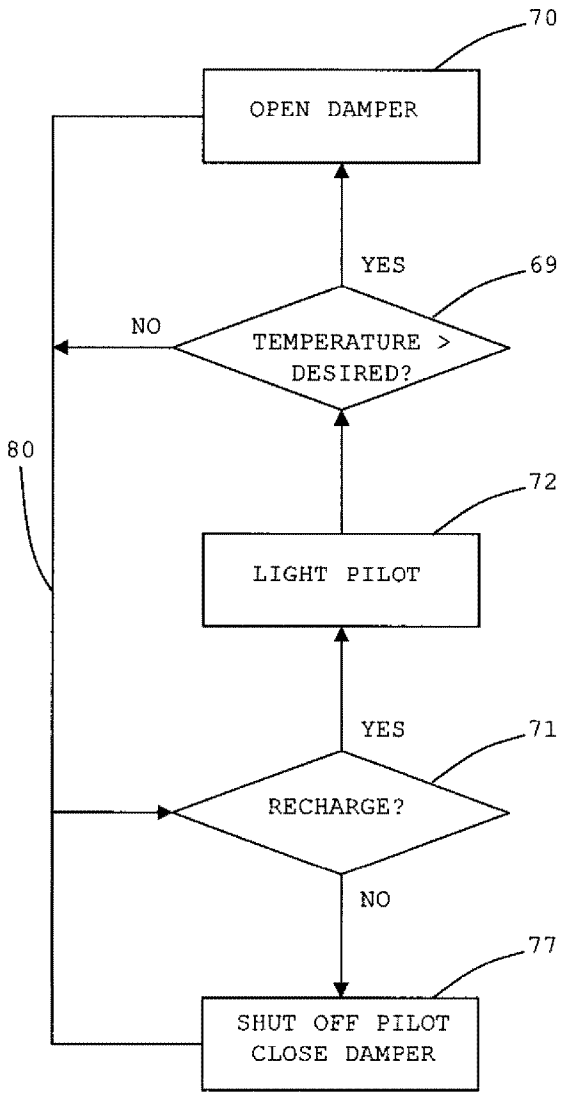
FIG. 6 is a flow diagram showing a recharge with over-temperature protection.

FIG. 6 is a flow diagram showing a recharge with over-temperature protection. A question of whether the temperature of the water in the heater tank is greater than desired may be asked at symbol 69. If the answer is yes, then the damper may be opened at symbol 70. If the answer is no, then a question of whether there should be a recharge may be asked at symbol 71. If the answer is yes, then the pilot may be lighted at symbol 72. If the answer is no, then the pilot may be shut off and the damper be closed at symbol 77. The status of the pilot light and the damper may be fed to symbol 71 via lines 80.

In the present specification, some of the matter may be of a hypothetical or prophetic nature although stated in another manner or tense.

Although the present system has been described with respect to at least one illustrative example, many variations and modifications will become apparent to those skilled in the art upon reading the specification. It is therefore the intention that the appended claims be interpreted as broadly as possible in view of the prior art to include all such variations and modifications.

What is claimed is:

1. A water heater comprising:

a water tank;

a combustion chamber proximate to the water tank and comprising a burner;

a pilot light configured to ignite the burner;

a flue configured to convey exhaust gases out of the combustion chamber;

a damper configured to block the exhaust gases when the damper is closed, wherein the damper is configured to be either open or closed when the pilot light is turned on;

a temperature sensor configured to sense a temperature indicative of a water temperature of water in the water tank; and a controller configured to control a position of the damper to maintain the temperature within the water tank within a predetermined temperature range when the water heater is in a standby mode in which the burner is off, wherein the controller is configured to turn the pilot light on in response to determining the temperature of the water tank is less than a threshold temperature.

2. The water heater of claim 1, wherein in the standby mode, the burner is off, the pilot light is off, and the damper is closed.

3. The water heater of claim 1, further comprising an electrical power storage device configured to provide electrical power to the water heater.

4. The water heater of claim 3, further comprising a heat-to-electric converter configured to recharge the electrical power storage device.

5. The water heater of claim 3, further comprising a light-to-electric converter configured to recharge the electrical power storage device.

6. The water heater of claim 5, wherein the light-to-electric converter comprises solar cells.

7. The water heater of claim 1, wherein the controller is configured to:

determine whether the electrical power storage device needs to be recharged, and in response to determining that the electrical power storage device needs to be recharged, turn on the pilot light.

8. The water heater of claim 1, wherein the threshold temperature is a first threshold temperature, and wherein the controller is further configured to, when the pilot light is on:

determine whether the temperature indicative of the water temperature is greater than a second threshold temperature greater than the first threshold temperature, and in response to determining that the temperature indicative of the water temperature is greater than the second threshold temperature and the damper is fully open, shut off the pilot light.

9. The water heater of claim 1, wherein when the water heater is in the standby mode, the controller is configured to open the damper in response to determining the temperature indicative of the water temperature is greater than a temperature setpoint plus X degrees Fahrenheit and close the damper in response to determining the temperature indicative of the water temperature is less than the temperature setpoint, wherein the temperature setpoint is within the predetermined temperature range.

10. The water heater of claim 1, wherein:

the controller is configured to control a position of the damper to maintain the temperature indicative of the water temperature at approximately a temperature setpoint, and the temperature setpoint is within the predetermined temperature range.

11. The water heater of claim 1, wherein the controller is configured to turn on the pilot light in response to determining that the temperature indicative of the water temperature is X degrees Fahrenheit below a temperature setpoint, and wherein the temperature setpoint is within the predetermined temperature range.

12. The water heater of claim 1, wherein the controller is configured to control a position of the damper based on the temperature indicative of the water temperature.

13. The water heater of claim 12, wherein the controller is configured to control a position of the damper to allow heat loss through the flue in response to determining that the temperature is rising.

14. The water heater of claim 1, further comprising a vent pipe coupled to the flue, wherein the damper is in the vent pipe.

15. The water heater of claim 1, wherein the damper is positioned at an exit of the flue.

16. The water heater of claim 1, wherein the temperature sensor is configured to sense the water temperature of the water in the water tank or the temperature of the water tank.

17. The water heater of claim 1, wherein the temperature sensor is configured to sense an air temperature.

18. A water heater comprising:

a water tank;

a burner;

a pilot light configured to ignite the burner;

a flue configured to convey exhaust gases out of the combustion chamber;

a damper configured to block the exhaust gases when the damper is closed, wherein the damper is configured to be either open or closed when the pilot light is turned on;

a temperature sensor configured to sense a temperature indicative of a water temperature of water in the water tank; and a controller configured to control a position of the damper to maintain the temperature within the water tank within a predetermined temperature range when the water heater is in a standby mode in which the pilot is off, wherein the controller is configured to turn the pilot light on in response to determining the temperature of the water tank is less than a threshold temperature.

19. The water heater of claim 18, further comprising an electrical power storage device configured to provide electrical power to the water heater, wherein the controller is configured to:

determine whether the electrical power storage device needs to be recharged, and in response to determining that the electrical power storage device needs to be recharged, turn on the pilot light.

20. The water heater of claim 18, wherein the controller is configured to turn on the pilot light in response to determining that the temperature indicative of the water temperature is X degrees Fahrenheit below a temperature setpoint.

* * * * *